US005217637A

United States Patent [19]

Balzer

[11] Patent Number: 5,217,637

[45] Date of Patent: Jun. 8, 1993

[54] AQUEOUS HYDRAULIC FLUIDS FOR ENERGY TRANSFER

[75] Inventor: Dieter Balzer, Haltern, Fed. Rep. of Germany

[73] Assignee: Huels Aktiengesellschaft, Marl, Fed. Rep. of Germany

[21] Appl. No.: 733,990

[22] Filed: Jul. 22, 1991

Related U.S. Application Data

[63] Continuation-in-part of Ser. No. 561,739, Aug. 1, 1990, abandoned.

[30] Foreign Application Priority Data

Aug. 10, 1989 [DE] Fed. Rep. of Germany ..... 3926397

[51] Int. Cl.[5] ..... C10M 173/02; C10M 129/00

[52] U.S. Cl. ..... 252/73; 252/49.3

[58] Field of Search ..... 252/73, 49.3

[56] References Cited

U.S. PATENT DOCUMENTS 2,956,951 10/1960 Furey ..... 252/49.3
3,772,269 11/1973 Lew ..... 252/174.17
4,233,170 11/1980 Genjida et al. ..... 252/73
4,257,902 3/1981 Singer ..... 252/49.5
4,705,665 11/1987 Malik ..... 252/174.17
4,732,696 3/1988 Urfer ..... 252/174.17

FOREIGN PATENT DOCUMENTS 1943689 12/1970 Fed. Rep. of Germany .
2360658 4/1978 France .
2016041 9/1979 United Kingdom .

*Primary Examiner*—Christine Skane
*Attorney, Agent, or Firm*—Oblon, Spivak, McClelland, Maier & Neustadt

[57] ABSTRACT

An aqueous hydraulic fluid comprising as, active ingredients, 5–30% by weight of alkylpolyglycoside, 0–20% by weight of surfactant additives, and 0–10% by weight of nonsurfactant additives; and water to 100% by weight; the proportion of active ingredients in the fluid being at most 40% by weight; provides a medium for energy transfer having adequate viscosity and good lubricating action at low concentrations of active ingredients.

4 Claims, No Drawings

AQUEOUS HYDRAULIC FLUIDS FOR ENERGY TRANSFER

CROSS-REFERENCE TO RELATED APPLICATIONS

This application is a C-I-P of Ser. No. 07/561,739, filed Aug. 1, 1990, now abandoned.

BACKGROUND OF THE INVENTION

1. Field of the Invention

The present invention relates to flame resistant hydraulic fluids which are ecologically safe and have good lubricating properties, and to a process for energy transfer utilizing the same.

2. Description of the Background

Hydraulic fluids based in particular on mineral oils are in common use. However, in mining, for safety reasons, flame resistant hydraulic fluids are necessary and these are used in a large number of applications, such as in coal cutting machines, tunnelling machines, turbo couplings and hydraulic props. However, even outside the mining industry, flame resistant fluids are preferred wherever disastrous fires could be caused by the escape of combustible media from the closed hydraulic system.

The current flame resistant hydraulic fluids are in particular aqueous systems, either oil-in-water emulsions (HFA) or glycol-polyglycol-water mixtures (HFC). The chief disadvantage of the o/w emulsions is that they are metastable systems which can become critical in particular because of temperature variations and electrolytes (DE-A-3,508,946). Where thickened systems are concerned, such as are required to avoid leakage losses from the seals in pumps and valves and to form lubricating films between solid surfaces in frictional contact, the polymers used usually have little shear stability, if any.

HFC fluids based on monoglycols, oligoglycols and polyglycols have, in addition to substantial flame resistance, the advantage of being physiologically harmless and ecologically acceptable (P. Lehringer, Erdöl und KohleErdgas-Petrochemie 41,230 (1988) ), which is particularly advantageous in mobile applications where leakages of hydraulic fluid often seep into the soil. These systems are also considered to be substantially shear-stable, which however can be viewed as a criticism since usually those polymers making the greatest contribution to the overall viscosity of the fluid are most susceptible to shear damage because of their chemical structure. A further disadvantage of the current HFC fluids is that the proportion of active ingredient must be very high so that a minimum viscosity is retained even at somewhat elevated temperatures. Water contents ≧50% are quite typical here (C. Rasp, Tribologie Schmierungstechn. 35, 185 (1988)). Moreover, the additive packages for producing good lubricating and anti-wear actions are very complex in these fluids. A need therefore continues to exist for hydraulic fluids of improved properties.

SUMMARY OF THE INVENTION

Accordingly, one object of the present invention is to provide flame resistant, ecologically safe hydraulic fluids which have an adequate viscosity and a good lubricating action at low concentrations of active ingredient.

Another object of the invention is to provide aqueous hydraulic fluids which are based on an aqueous surfactant solution.

A still further object of the invention is to provide an effective process for the transfer of energy by a flame resistant, ecologically safe hydraulic fluid which has an adequate viscosity and good lubricating action at low concentrations of active ingredient.

Accordingly, these objects and other objects of the present invention as hereinafter will become more readily apparent can be attained by the provision of: a fluid comprising 5–30% by weight of alkylpolyglycoside, 0 to 20% by weight of at least one surfactant, 0–10% by weight of at least one non-surfactant component and water to 100% by weight, the proportion of the active ingredients being at most 40% by weight; and a process for transferring energy comprising providing a hydraulic system containing a hydraulic fluid, transferring energy into said hydraulic fluid contained in said hydraulic system at a first location in said hydraulic system, and recovering energy from said hydraulic fluid contained in said hydraulic system at a second location in said hydraulic system, the improvement comprising:

said hydraulic fluid being an aqueous hydraulic fluid comprising as active ingredients:

5–30% by weight of alkylpolyglycoside of the formula R-O-$Z_n$, in which R represents a linear or branched, saturated or unsaturated alkyl radical having 8 to 20 carbon atoms and $Z_n$ represents an oligoglycoside radical with an average n=1 to 10 hexose units or pentose units or combinations thereof, 0–20% by weight of surfactant additives, and 0–10% by weight of non-surfactant additives selected from the group consisting of pH regulators, corrosion inhibitors, vapor phase inhibitors, antifoams, solubility promoters, water-soluble polymers for adjusting the temperature profile of the viscosity and preservatives; and water to 100% by weight, the proportion of active ingredients in the fluid being at most 40% by weight.

DETAILED DESCRIPTION OF THE PREFERRED EMBODIMENTS

Surprisingly, it has now been found that alkylpolyglycosides have, both alone at relatively low concentrations and in the presence of other surfactants, a particularly high viscosity level coupled with a very good lubricating action.

Alkylpolyglycosides

The alkylpolyglycosides employed in the invention have the formula (I):

$$R—O—Z_n, \quad (I)$$

in which R represents a linear or branched, saturated or unsaturated alkyl radical having 8 to 20, preferably 9 to 18, carbon atoms and $Z_n$ represents an oligoglycoside radical having an average n=1 to 10, preferably 1 to 5, hexose units or pentose units or mixtures thereof.

The alkyloligoglycosides can be prepared wholly or partly based on renewable raw materials, by known processes. For example, dextrose can be reacted in the presence of an acidic catalyst with n-butanol to form butyloligoglycoside mixtures which are converted with long-chain alcohols, likewise in the presence of an acidic catalyst, into the desired alkyloligoglycoside mixtures. The formula of the products can vary within certain limits. The alkyl radical R is determined by the choice of long-chain alcohol. It is advantageous on economic grounds to use industrially accessible surfactant alcohols having 8 to 20 carbon atoms, for example oxo alcohols, Ziegler alcohols and natural alcohols from the hydrogenation of fatty acids and fatty acid derivatives.

The oligoglycosyl radical $Z_n$ is determined, on the one hand, by the selection of the carbohydrate and, on the other hand, by the regulation of the average degree of oligomerization n, for example, according to DE-A-1,943,689. In principle, it is possible to convert known polysaccharides, oligosaccharides and monosaccharides, for example, starch, maltodextrin, dextrose, galactose, mannose, xylose and so on into alkyloligoglycosides. Particular preference is given to the industrially accessible carbohydrates, i.e., starch, maltodextrin and dextrose. Since the industrially relevant alkylpolyglycoside-syntheses are not regio-selective or stereoselective, the alkylpolyglycosides are always mixtures of oligomers which in turn are mixtures of different isomeric structures. Pyranose and furanose structures are present side by side, with $\alpha$- and $\beta$- glycosidic linkages. Even the linkage positions differ between pairs of saccharide radicals.

Depending on the method of synthesis, the alkylpolyglycosides may also contain associated substances such as residual alcohols, monosaccharides, oligosaccharides and oligoalkylpolyglycosides.

Surfactant additives

The flame resistant hydraulic fluids according to the invention can moreover contain up to 20% by weight of surfactant additives which are selected from the following compounds, which compounds can be used in combinations:

a) Alkylbenzenesulfonates or dialkylbenzenesulfonates of the formula (II)

$$R(R_1)C_6H_3SO_3M \quad \text{(II)}$$

in which R denotes a branched or unbranched alkyl radical having 8 to 20 carbon atoms, $R_1$ denotes hydrogen or a branched or unbranched alkyl radical having 1 to 10 carbon atoms, where the total number of carbon atoms in R and $R_1$, is at least 8, preferably 10 to 18, and M denotes Na, K, ammonium or alkylammonium.

b) Alkanesulfonates and/or olefinsulfonates of the formula (III)

$$R''SO_3M' \quad \text{(III)}$$

in which R'' denotes a saturated or unsaturated, branched or unbranched alkyl radical having 8 to 20 carbon atoms and M' denotes Na, K, ammonium or alkylammonium.

c) Petroleumsulfonates d) Fatty alcohol derivatives or alkylphenol derivatives of the following formula (IV):

$$[R'''(C_6H_4)_xO(R''''O)_y]_zU_vM'', \quad \text{(IV)}$$

in which R''' denotes a saturated, branched or unbranched alkyl radical having 6 to 20, preferably 8 to 16, carbon atoms, x=0 or 1, R'''' denotes $C_2H_4$ or $C_3H_6$, y is 0 to 15, z is 1 or 2, U denotes $SO_3$, $CH_2COO$, CHCOO, v is 0 or 1 and M'' denotes H, Na, K, ammonium or alkylammonium.

e) Other surfactant additives are carboxylic acids with relatively long, branched or unbranched, saturated or unsaturated hydrocarbon chains and also partial esters of phosphoric acid in particular those of alcohols or of fatty alcohol ethoxylates or of alkylphenol ethoxylates. The latter can be prepared by reacting the relevant alcohols or oxyethylates with phosphoric acids, phosphorus oxides or phosphorus halides.

Finally, cationic surfactants such as quaternary ammonium compounds also have advantageous effects as additives to alkylpolyglycosides in aqueous hydraulic fluids, for example, a pronounced improvement in the lubricating properties.

Non-surfactant additives

Suitable non-surfactant additives in the hydraulic fluid of the present invention are amines or alkanolamines used as pH regulators or corrosion inhibitors; sodium molybdate, boric acid aminoesters, benzotriazole or toluenetriazole likewise as corrosion inhibitors; morpholine or N-methylmorpholine as vapor phase inhibitors; silicone antifoams or other antifoams; glycol and/or glycol ethers or urea as solubility promoters and optionally water soluble polymers for adjusting the temperature profile of the viscosity and also preservatives.

Besides innocuous water as the solvent, the hydraulic fluid of the present invention is based on alkylpolyglycosides which are a toxicologically harmless class of surfactants having excellent biodegradability (95 to 97% by weight coupled unit test, DOC). 3 to 30% by weight, preferably 5 to 25% by weight, of alkylpolyglycoside is present in the fluid of the present invention and the total concentration of active ingredients is at most 40% by weight, preferably 35% by weight.

The hydraulic fluids according to the invention are usually clear in the temperature range between 5° and 80° C., or may be slightly opalescent in the presence of silicone antifoams. The fluids are usually rendered weakly alkaline.

The hydraulic fluids of the present invention may be utilized in any conventional hydraulic system, but are found to be especially useful, as previously noted, in applications where flame resistant fluids are desired, e.g., the mining industry.

As is well-known, the moving parts of many industrial machines are actuated by liquid (hydraulic fluid) that is under pressure. A system used to apply the hydraulic fluid may consist of a reservoir, a device for transferring energy into the hydraulic fluid (e.g., a piston, a motor-driven pump, etc.), control valves, a device for recovering energy from the hydraulic fluid (e.g., a piston, a fluid motor, etc.) and piping to connect these units, forming a hydraulic system.

Hydraulic actuation is based on Pascal's discovery that pressure which has developed in a fluid acts equally and in all directions through the fluid and behaves as a hydraulic lever or force multiplier, e.g., a 5 kg wt acting on a 10 $cm^2$ piston develops a pressure which, when transmitted to a 100 $cm^2$ piston enables the 100 $cm^2$ piston to support a 50 kg weight. When motion occurs (in a closed system), the small piston (10 $cm^2$) must move 10 cm in order to move the large piston (100 $cm^2$) 1 cm. This is necessary, since (in a closed system) the volume of liquid leaving one cylinder must equal the volume entering the other cylinder.

Hydraulic systems have been used in numerous combinations to suit the needs of many industrial machines. Speed can be controlled easily by controlling the volume of fluid flow. Force can be applied in any direction, transmitted around corners and to remote parts of machines, and can be easily controlled by control of fluid pressure. The direction of movement is controllable by control of the direction of oil flow. Smooth operation is achieved by an inherent cushioning effect; and protection against overload can be attained by provision for oil-pressure relief.

Hydraulic actuation is applied to machine tools, presses, draw benches, jacks and elevators, as well as to die-casting, plastic-molding, welding, coal-mining, and tube-reducing machines. Hydraulic loading is used for pressure, sugar-mill, and paper-machine press rolls, as well as calendar stacks. The lifting and tilting mechanisms of dump trucks and fork lift trucks are often hydraulically operated.

Positive, adjustable-speed hydraulic transmissions are used for driving paper mills, wire-rope machines, and printing presses. These transmissions are used on ships for steering gears, hoisting and mooring equipment and, in the case of naval vessels, to elevate and train guns.

Hydrostatic transmissions are used in many self-propelled harvesting machines and garden tractors and in large tractors and construction machines. In the sense that no clutch is used and no gear shifting is involved, this type of transmission could be called automatic, but otherwise has no similarity to the conventional hydrokinetic automatic transmission (where power is transferred from the engine to the gear box by first converting it into kinetic energy of a fluid in the "pump" and then converting the kinetic energy in the fluid back to mechanical energy in the "turbine"). In the hydrostatic systems, engine power is converted into static pressure of a fluid in the pump, and the static pressure acts on a hydraulic motor to produce the output.

The fluids of the present invention may be used in any of the aforementioned applications, but find especial advantage where fire-resistant fluids are desirable, e.g., where the fluid could spray or drip, from a break or leak, onto a source of ignition.

Having generally described this invention, a further understanding can be obtained by reference to certain specific examples which are provided herein for purposes of illustration only and are not intended to be limiting unless otherwise specified.

MARLON ® A is the sodium salt of a linear $C_{10}$-$C_{13}$-alkylbenzenesulfonic acid (Hüls AG)

MARLON ® PS is the sodium salt of a $C_{13}$-$C_{17}$-paraffinsulfonic acid (Hüls AG)

Polymekon ® 730 is a silicone antifoam (Goldschmidt AG)

EXAMPLE 1

A 15% by weight solution of $C_{12}$-$C_{13}$-alkylpolyglycoside (average DP 1.7, determined via $^1$H-NMR) is prepared in deionized water. The viscosity behavior of the solution (rotational viscometer, Haake RV 20, M 5, 50° C., shear rate range 30–300 sec$^{-1}$) is newtonian and the viscosity is about 150 mPa.s. Repeated ultrasound bombardment (Telsonic USG 1000, 20 kHz) for periods of 10 minutes did not alter the viscosity and confirms the expected shear stability of the system. The clarification temperature of the solution is 10° C. The solution undergoes no optical change with increasing temperature (up to 80° ). The wear characteristics (lubricating action) of the solution were investigated using the Reichert frictional wear balance (weight loss of the test rolls after a frictional path of 100 m under a load of 1500 g). The average of 3 test runs was 6.6±0.5 mg at a specific surface pressure of 2400 N/cm$^2$. No foaming was observed during the wear measurement. Comparative wear tests with deionized water on the one hand, and Ecubasol Hydrotherm ® 36 (glycol-based hydraulic fluid), on the other hand, gave, under the same conditions, weight losses of 66 and 6.9 mg. Comparison of the results demonstrates that even a 15% by weight solution of the alkylpolyglycoside has not only an adequate viscosity level but also pronounced lubricating properties.

EXAMPLE 2

A 15% by weight solution of N-$C_{12}$-$C_{18}$-N,N,N-trimethylammonium chloride in deionized water has a low Viscosity (about 1 mPa.s) at 50° C. and its anti-wear effect, determined as in Example 1, is only moderate with a weight loss figure of 34.5 mg. However, if half of the quaternary ammonium compound is replaced by $C_{12}$–$C_{13}$-alkylpolyglycoside (average DP 1.7), a pronounced lubricating action results, with a weight loss of 10.9±0.6 mg, while the viscosity remains almost unchanged and the clarification temperature increases from +2° C. to +5° C.

EXAMPLE 3

A 10% by weight solution of $C_{10}$–$C_{14}$-alkylpolyglycoside (average DP about 1.3) in deionized water has newtonian flow behavior and a viscosity of 70 mPa.s at 50° C. The investigation of the wear behavior carried out as in Example 1 gave a weight loss of the test piece of 15 mg.

EXAMPLES 4 to 13 (TABLES)

The relevant examples demonstrate the effectiveness of the mixtures according to the invention with regard to the viscosity level and anti-wear properties. The ultrasound bombardment carried out with the solutions corresponding to Examples 4 and 10 (2 exposures of 10 minutes with the viscosity being determined after each exposure) demonstrates complete shear stability of the structures producing elevated viscosity. Examples 11 and 12 demonstrate the effectiveness of the mixtures according to the invention in waters of different hardnesses (calcium hardness).

TABLE 1

| Composition (% by weight) | Example No. 4 | 5 | 6 | 7 | 8 |
|---|---|---|---|---|---|
| $C_{12}C_{13}$-Alkylpolyglycoside (average DP 1.7) | — | 8.5 | 10 | 7 | 16 |
| $C_{10}C_{14}$-Alkylpolyglycoside (average DP 1.3) | 12.5 | — | — | — | — |
| MARLON A ® | — | 8.5 | — | 7 | — |
| MARLON PS ® | 12.5 | — | 10 | — | — |
| Triisopropylammonium oleate | — | 4 | — | — | 4 |
| Partial ester of phosphoric acid with ethoxylated nonylphenol having 7 mol of ethylene oxide/mol | — | — | — | 4 | — |
| Poylmekon ® 730 | 0.15 | — | — | — | — |
| Isopropanolamine | 3 | 3 | 3 | 3 | 3 |
| Ethylene glycol | — | — | — | — | 15 |
| Viscosity 50° C. (cSt) | 20 | 47 | 4 | 57 | 29 |
| Clarification temperature (°C.) | — | 3 | 5 | 5 | 3 |
| pH | 8.1 | 8.6 | 9.7 | 8.5 | 8.2 |

TABLE 1-continued

| Composition (% by weight) | Example No. 4 | 5 | 6 | 7 | 8 |
|---|---|---|---|---|---|
| Frictional wear test[1] (mg) | 4.5 | 8.6 | 9.7 | 8.5 | 8.2 |
| Foam (DIN 53 902) | — | — | [2] | — | — |

[1]Average from 3 test runs with a frictional path of 100 m and a surface pressure between 3000 and 5000 N/cm$^2$.
[2]The same test in the presence of 0.15% by weight of Polymekon ® 730 gives no foam.

TABLE 2

| Composition (% by weight) | Example No. 9 | 10 | 11[2] | 12[3] | 13 |
|---|---|---|---|---|---|
| $C_{12}C_{13}$-Alkylpolyglycoside (average DP 1.7) | — | 8 | 13 | 13 | 25 |
| $C_{10}C_{14}$-Alkylpolyglycoside (average DP 1.3) | 7 | — | — | — | — |
| MARLON A ® | 7 | 8 | — | — | — |
| MARLON PS ® | — | — | 13 | 13 | — |
| Triisopropylammonium oleate | — | — | — | — | — |
| Partial ester of phosphoric acid with ethoxylated nonylphenol having 7 mol of ethylene oxide/mol | 4 | 4 | — | — | — |
| Polymekon ® 730 | — | — | 0.15 | 0.15 | — |
| Isopropanolamine | 3 | 3 | 3 | 3 | 3 |
| Ethylene glycol | — | 15 | — | — | — |
| Viscosity 50° C. (cSt) | 51 | 21 | 32 | 34 | 71 |
| Clarification temperature (°C.) | 1 | 5 | — | — | 6 |
| pH | 9.1 | 8.7 | 8.0 | 8.1 | 9.6 |
| Frictional wear test[1] (mg) | 3.8 | 1.4 | 2.2 | 2.3 | 2.1 |
| Foam (DIN 53 902) | — | — | — | — | — |

[1]Average from 3 test runs with a frictional path of 100 m and a surface pressure between 3000 and 5000 N/cm$^2$.
[2]Water with 20 degrees of German hardness.
[3]Water with 50 degrees of German hardness.

Having now fully described the invention, it will be apparent to one of ordinary skill in the art that many changes and modifications can be made thereto without departing from the spirit or scope of the invention as set forth herein.

What is claimed as new and desired to be secured by letters patent of the U.S. is:

1. In a process for transferring energy comprising providing a hydraulic system containing a hydraulic fluid, transferring energy into said hydraulic fluid contained in said hydraulic system at a first location in said hydraulic system, and recovering energy from said hydraulic fluid contained in said hydraulic system at a second location in said hydraulic system, the improvement comprising:

said hydraulic fluid being an aqueous hydraulic fluid comprising as active ingredients:

5–30% by weight of alkylpolyglycoside of the formula R—O—$Z_n$, in which R represents a linear or branched, saturated or unsaturated aliphatic radical having 8 to 20 carbon atoms and $Z_n$ represents an oligoglycoside radical with an average n=1 to 10 hexose units or pentose units or combinations thereof, 0–20% by weight of surfactant additives, and 0–10% by weight of non-surfactant additives selected from the group consisting of pH regulators, corrosion inhibitors, vapor phase inhibitors, antifoams, solubility promoters, water-soluble polymers for adjusting the temperature profile of the viscosity and preservatives; and water to 100% by weight, the proportion of active ingredients in the fluid being at most 40% by weight.

2. The process according to claim 1, wherein said surfactant additives are selected from the group consisting of organic sulfates, organic sulfonates, partial esters of phosphoric acid, oxyethylates, carboxymethylated oxyethylates, salts of carboxylic acids and quaternary ammonium salts.

3. The process according to claim 1, wherein said solubility promoter is present and said solubility promoter is a glycol, glycol ether, combination of a glycol and a glycol ether or urea.

4. The process according to claim 1, wherein said corrosion inhibitor is present and said corrosion inhibitor is an amine, an alkanolamine, sodium molybdate, boric acid aminoesters, benzotriazole or toluenetriazole.

* * * * *